US010363756B1

(12) United States Patent
McConville et al.

(10) Patent No.: US 10,363,756 B1
(45) Date of Patent: Jul. 30, 2019

(54) SYSTEM AND METHOD FOR DE-SKEWING SUBSTRATES AND LATERALLY REGISTERING IMAGES ON THE SUBSTRATES IN A PRINTER

(71) Applicant: Xerox Corporation, Norwalk, CT (US)

(72) Inventors: Paul J. McConville, Webster, NY (US); Chu-Heng Liu, Penfield, NY (US); Jason M. LeFevre, Penfield, NY (US); Douglas K. Herrmann, Webster, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/982,477

(22) Filed: May 17, 2018

(51) Int. Cl.

| | |
|---|---|
| ***B41J 11/00*** | (2006.01) |
| ***B41J 11/44*** | (2006.01) |
| ***B41J 2/01*** | (2006.01) |
| ***B41J 11/04*** | (2006.01) |
| *B41J 11/42* | (2006.01) |

(52) U.S. Cl.
CPC ..... *B41J 11/0055* (2013.01); *B41J 2/01* (2013.01); *B41J 11/005* (2013.01); *B41J 11/0095* (2013.01); *B41J 11/04* (2013.01); *B41J 11/44* (2013.01); *B41J 11/42* (2013.01)

(58) Field of Classification Search
CPC ..... B41J 2/04573; B41J 2/04505; B41J 2/04551; B41J 2/04586; B41J 2/2132; B41J 2/2135; B41J 2/51; B41J 11/0055; B41J 11/005; B41J 11/04; B41J 11/44; B41J 12/01; B41J 11/0095; B41J 11/46
See application file for complete search history.

(56) References Cited

U.S. PATENT DOCUMENTS

| | | | | |
|---|---|---|---|---|
| 6,137,517 | A | 10/2000 | Furst et al. | |
| 6,736,394 | B2 | 5/2004 | Herrmann et al. | |
| 6,862,375 | B1 | 3/2005 | Keithley et al. | |
| 7,748,697 | B2 | 7/2010 | Fujita et al. | |
| 8,169,657 | B2 * | 5/2012 | Wang | H04N 1/50 347/115 |
| 8,206,048 | B2 * | 6/2012 | Ferrara | B65H 9/002 400/578 |
| 2008/0296835 | A1 | 12/2008 | Dejong et al. | |
| 2011/0156345 | A1 | 6/2011 | deJong et al. | |
| 2011/0273502 | A1 * | 11/2011 | Eun | B41J 2/17593 347/14 |
| 2018/0326721 | A1 * | 11/2018 | Tatsuda | B41J 2/04573 |

* cited by examiner

*Primary Examiner* — Thinh H Nguyen
(74) *Attorney, Agent, or Firm* — Maginot Moore & Beck LLP

(57) ABSTRACT

A printer uses a mechanical device to correct skew in substrates and uses an electronic lateral registration system to shift ink images to be placed on the de-skewed substrates to remove the need for mechanical components that laterally register de-skewed substrates. The removal of the mechanical lateral registration components enable the substrates to be printed more quickly than printers that use mechanical devices to both de-skew substrates and laterally register de-skewed substrates in a print zone.

18 Claims, 3 Drawing Sheets

SYSTEM AND METHOD FOR DE-SKEWING SUBSTRATES AND LATERALLY REGISTERING IMAGES ON THE SUBSTRATES IN A PRINTER

TECHNICAL FIELD

This disclosure relates generally to devices for handling substrates in printers prior to printing the substrates, and more particularly, to de-skewing the substrates prior to printing in such printers.

BACKGROUND

Accurate and reliable registration of substrate media as the media travel in a process direction through the printer are important for the production of quality images. Even a slight skew or misalignment of the substrate media as the substrate passes the printheads for image formation can lead to image and color registration errors. As substrate processing speeds increase, nip assemblies or belts used to correct skew and adjust for lateral registration of the substrate media intensify the force applied by the rollers in these assemblies so the skew and lateral registration can be corrected within the decreasing time provided for such correction. The force applied by the rollers may wrinkle, tear, or buckle medium and light-weight substrate media. Accordingly, a printer that can register images on substrates and de-skew substrate media before printing in these high-speed printing systems without applying forces that can wrinkle, tear, or buckle the substrate media would be beneficial.

SUMMARY

A new printer includes a mechanical de-skewing device and an electronic image registration system to handle substrates efficiently prior to printing to increase the speed of substrate printing beyond that achieved with printers that use mechanical devices to both de-skew and laterally register images on substrates. The printer includes a mechanical de-skewing device configured to identify an amount of skew in an incoming substrate and to remove the identified amount of skew from the incoming substrate to de-skew the substrate, and an electronic lateral registration system configured to identify a lateral position of the de-skewed substrate in a print zone and send image data only to inkjets that correspond to a width of the de-skewed substrate at the identified lateral position of the de-skewed substrate in the print zone.

A method of printer operation mechanically de-skews substrates and electronical registers images on the substrates to increase the speed of printing to that achieved by printers that use mechanical devices for both de-skewing and laterally registering images on the substrates. The method includes identifying with a mechanical de-skewing device an amount of skew in an incoming substrate, removing with the mechanical de-skewing device the identified amount of skew from the incoming substrate to de-skew the substrate, identifying with an electronic lateral registration system a lateral position of the de-skewed substrate in a cross-process direction in a print zone, and sending with the controller image data only to inkjets that correspond to a width of the de-skewed substrate at the identified lateral position of the de-skewed substrate in the print zone.

BRIEF DESCRIPTION OF THE DRAWINGS

The foregoing aspects and other features of a printer that includes a mechanical de-skewing substrate device and an electronic image registration system to increase the speed of printing beyond what can be achieved with printers that use mechanical devices to both de-skew substrates and laterally register images on the substrates are explained in the following description, taken in connection with the accompanying drawings.

DETAILED DESCRIPTION

Figure 1:
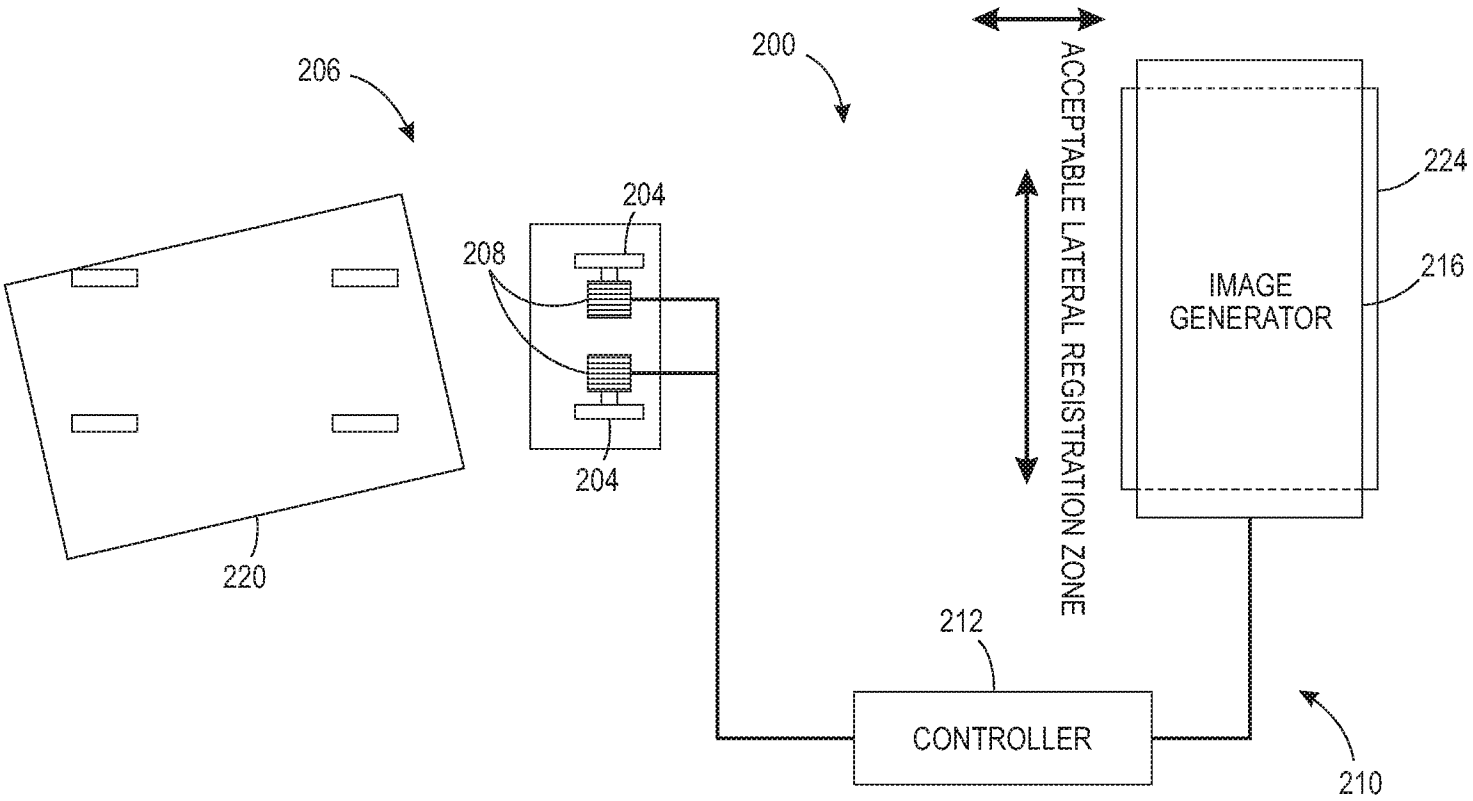
FIG. 1 is a diagram of a printer that corrects skew in substrates and shifts an image to be formed on the de-skewed substrates to remove the need for lateral registration of the de-skewed substrates.

For a general understanding of the present embodiments, reference is made to the drawings. In the drawings, like reference numerals have been used throughout to designate like elements.

Figure 3:
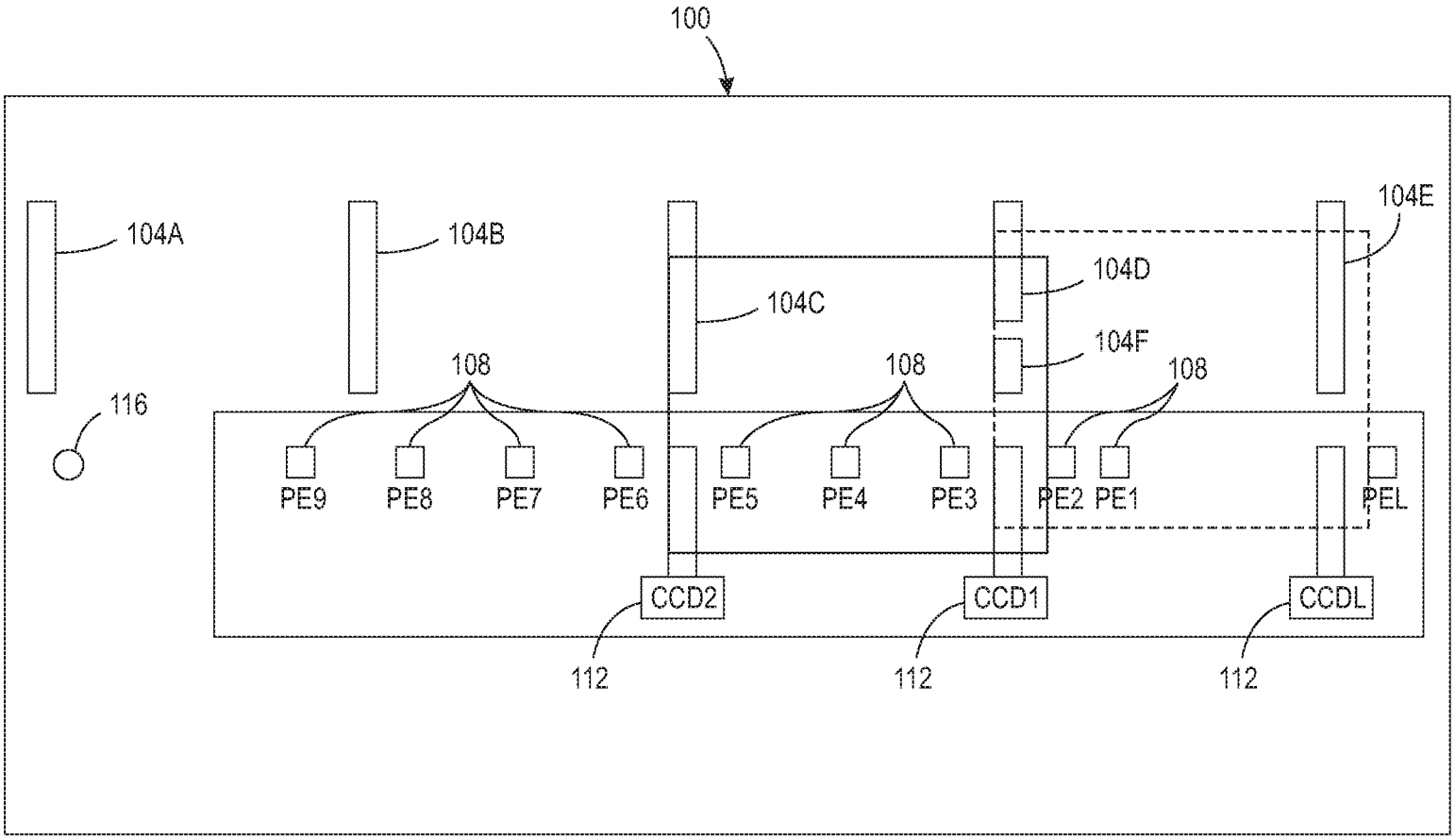
FIG. 3 PRIOR ART
FIG. 3 depicts a prior art printer that de-skews and laterally registers substrates before printing the substrates.

FIG. 3 depicts a known substrate registration system 100 in a printer that is configured to de-skew substrate media and register the substrates for image printing. The system 100 includes five nips 104A, 104B, 104C, 104D, and 104E, photoelectric sensors 108, charge coupled device (CCD) sensors 112, and a registration entrance sensor 116. The nips 104A-104E are formed by roller pairs. The registration entrance sensor 116 detects the leading edge of a substrate to initiate the operation of the system 100. The photoelectric sensors 108 are used to monitor the progress of the leading edge and trailing edge in the system to trigger the CCDs, operate rollers in the nips, and other timing functions. The CCD sensors 112 identify the amount of skew and lateral offset of the substrates by detecting the positions of the substrates traveling closest to the CCD sensors 112 through the system 100. The identified skew and lateral offset are used to vary the speeds of the rollers in the nips 104D and 104F to rotate and translate the substrates because the actuators driving the rollers in nip 104D and 104F are independently controlled to slow down one side of a substrate so the skewed portion of the substrate can catch up to the slowed side and remove the skew or translate the substrate. For example, as shown in FIG. 3, the CCD sensors 112 identify the positions of the edge of the substrate closest to the CCD2 and CCD1 sensors and the controller that receives the signals from these sensors determines the substrate is not skewed since both sensors are equidistant from the edge opposite the sensors. These signals, however, are used by the controller to determine that the substrate is not centered with the print zone of the printer. To move the substrate to the center of the print zone, which follows the section of the media transport path shown in the figure, the controller operates the actuators rotating the rollers in nip 104F to accelerate the substrate and to decelerate the rollers in nip 104D. This action introduces skew that points the substrate towards the center. Subsequently, the controller operates the actuators in these two nips to decelerate the rollers in nip 104F and accelerate the rollers in nip 104D to de-skew the substrate at a position that centers the substrate with the print zone. The nips 104D, 104E and 104F then direct the laterally registered substrate, shown in dashed lines in the figure, towards the print zone. The rightmost photoelectric sensor 108 in FIG. 3 detects the leading edge of the de-skewed and laterally registered substrate for timing of the image transfer or image printing onto the substrate.

The system 100 limits the processing speed of the substrates in the printer and applies significant forces to the substrates to perform the simultaneous correction of skew and lateral offset. These forces can be capable of wrinkling, buckling, or tearing the lighter weight substrates. This type of de-skewing and image registering system is a mechanical system because while electronic sensors and a controller are used to detect the edges of substrates, the physical de-skewing and lateral registration is performed with mechanical components that realign and shift the substrates.

To address the issues arising from the system 100, de-skewing has been decoupled from lateral image registration so the de-skewing can be performed mechanically and the image registration be performed electronically without having to shift the position of the substrate after de-skewing has occurred. The new system 200 is shown in FIG. 1 and includes a mechanical de-skewing device 206 and an electronic lateral image registration system 210. As used in this document with regard to system 200 and what is claimed, the term "mechanical de-skewing device" refers to a device that only de-skews physically a substrate. One embodiment of a mechanical de-skewing device includes a pair of nips 204, each of which is formed by a pair of rollers. The first pair and the second pair of rollers forming nips 204 are separated from one another in a cross-process direction and are positioned at a same position in a process direction. As used in this document, the term "process direction" refers to the direction of motion of the substrate as it passes through a printer and the term "cross-process direction" refers to an axis that is perpendicular to the process direction in the plane of the substrate. At least one roller of each nip 204 is driven by an actuator 208 and each actuator 208 is independently operated by the controller 212.

The controller 212 is configured with programmed instructions stored in a memory operatively connected to the controller 212 and the execution of these instructions by the controller enables the controller to receive signals generated by photoelectric sensors and CCD devices as described above with regard to FIG. 3 and determine the amount of skew in a substrate 220 approaching the nips 204. The execution of these instructions further enable the controller to generate signals for the actuators 208 that rotate the driven roller in each nip 204 at different speeds to correct the detected skew in the substrate. As used in this document, the term "de-skew" refers to the orienting of a substrate so the leading edge and the trailing edge of the substrate is perpendicular to the process direction.

Once the substrate is de-skewed, the controller 212 uses CCD sensor data to identify the lateral position of the substrate and the process direction path of the substrate into and through the print zone 224. As used in this document, "print zone" means an area aligned with the process direction of a substrate in which an ink image is either transferred to or printed directly on the substrate. The print zone 224 is an area in which an image generator 216 forms an ink image on the de-skewed substrate. In some printers, the image generator is an array of printheads, each of which has a plurality of inkjets that form an ink image on an intermediate rotating member and the intermediate rotating member forms a nip with a rotating transfer member underlying the intermediate member and the path of the substrate through the print zone so the image formed on the intermediate member is transferred to the substrate as the substrate passes through the nip. In other printers, the image generator 216 includes an array of printheads, each of which has a plurality of inkjets. The printheads are positioned within the print zone and oriented to enable the inkjets to eject drops of ink directly onto the substrate to form an ink image on the substrate as the substrate passes through the print zone. The image generator 216 that uses an intermediate rotating member to transfer an ink image to the substrate or the image generator 216 that includes a printhead array that forms an ink image directly on the substrate is wider than the widest substrate that passes through the print zone. This excess capacity on either side of a substrate enables the controller 212 to shift laterally the image data that drives the inkjets in the printheads to shift laterally the image formed by the ejected ink on either the intermediate rotating member or the substrate directly.

In the image generator having the intermediate rotating member, the image is formed on a portion of the intermediate rotating member that enables the image to be centered on the de-skewed substrate as the image on the intermediate rotating member and the de-skewed substrate passed through the nip between the intermediate rotating member and the rotating transfer member long. Of course, the inboard and outboard sides of the de-skewed substrate must be completely within the lateral registration zone as shown in the figure. In the embodiment of the image generator that directly ejects ink onto the substrate, the shifting of the image data operates the inkjets in the printheads so the formed image is centered on the de-skewed substrate as it passes through the print zone. The shifting of the image in the print zone eliminates the need for laterally centering the de-skewed substrate between the inboard and outboard sides of the lateral registration zone as required in previously known printers. Because the substrate does not require lateral movement prior to passing through the print zone, the forces needed to achieve that lateral substrate movement are also eliminated. Thus, the substrate is not slowed for mechanical lateral registration and the speed of printing is increased over printing systems that use mechanical devices for both de-skewing and lateral registration of the substrates. Additionally, the risk of tearing, wrinkling, or cockling of the substrate is reduced with the elimination of the forces generated by mechanical lateral registration devices. As used in this document, the term "electronic lateral registration system" refers to a controller configured with programmed instructions that cause the controller to identify a lateral position for a de-skewed substrate as it passes through a print zone and send image data to inkjets in printheads that operate only those inkjets that correspond to a width of the de-skewed substrate at the identified lateral position in the print zone.

Figure 2:
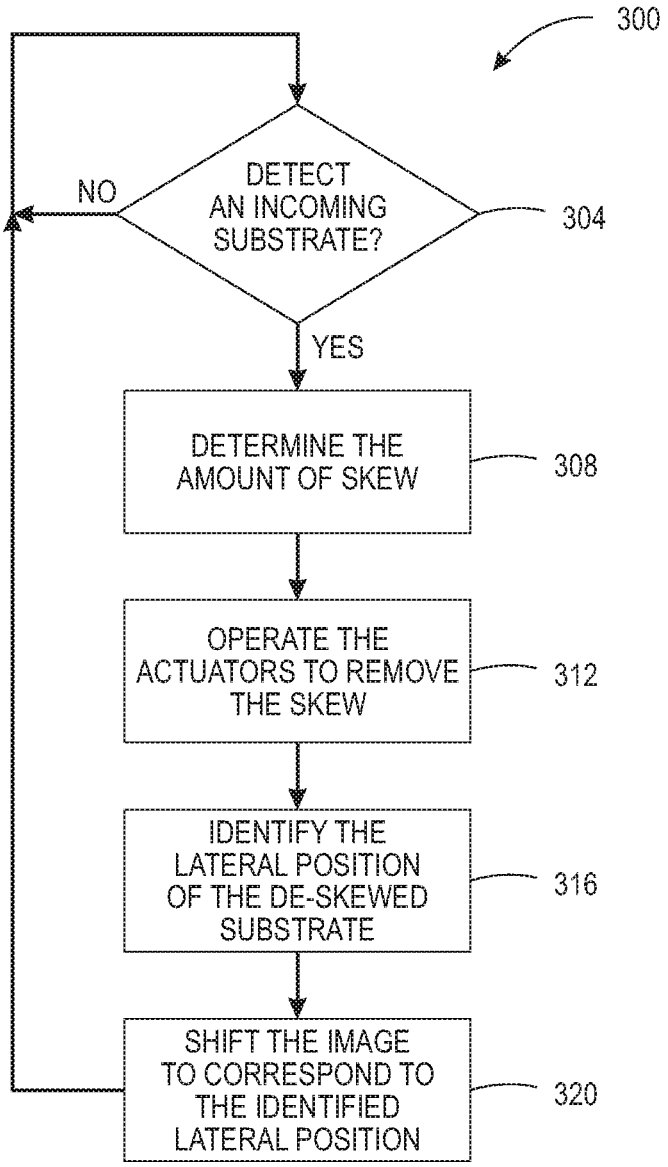
FIG. 2 depicts a process for operating the printer of FIG. 1.

A process for operating the printer 200 is shown in FIG. 2. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 212 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

FIG. 2 is a flow diagram of a process 300 that operates the printing system 200 to de-skew a substrate mechanically and shift an image electronically for printing or transfer to the de-skewed substrate in the print zone. The process 300 begins detection of a substrate approaching the de-skewing nips (block 304). The controller receives signals from the photoelectric sensors and CCD sensors to determine the amount of skew in an incoming substrate from the inboard and outboard positions of the substrate (block 308). The controller operates the actuators for the driven rollers in the de-skewing nips to remove the skew from the substrate (block 312) and the new inboard and outboard positions are identified with reference to the signals from the photoelectric sensors and the CCD sensors to determine the lateral position of the de-skewed substrate when it enters the print zone (block 316). The image data used to operate the inkjets in the printheads are shifted to either form the ink image on the intermediate rotating member on a portion of the intermediate rotating member that corresponds to the lateral position of the de-skewed substrate in the print zone or to center the ink image directly formed on the de-skewed substrate at the lateral position determined by the controller (block 320). The image shifted on the rotating intermediate member is transferred to the de-skewed substrate at the lateral position in the print zone determined by the controller. For a printed image, the inkjets receiving the shifted image data center the ink image on the de-skewed substrate at the lateral position of the de-skewed substrate in the print zone that was identified by the controller. After the image is either transferred or printed on the substrate, the process repeats by waiting for the detection of the next incoming substrate (block 304).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a mechanical de-skewing device configured to identify only an amount of skew in an incoming substrate and to remove only the identified amount of skew from the incoming substrate to de-skew the substrate before the incoming substrate enters a print zone; and an electronic lateral registration system configured to identify only a lateral position of the de-skewed substrate in the print zone and send image data only to inkjets that correspond to a width of the de-skewed substrate at the identified lateral position of the de-skewed substrate before the de-skewed substrate enters the print zone.

2. The printer of claim 1, the mechanical de-skewing device further comprising:

a first pair of rollers;

a second pair of rollers, the first pair and the second pair of rollers being separated from one another in a cross-process direction and being positioned at a same position in a process direction;

a first actuator operatively connected to at least one roller in the first pair of rollers;

a second actuator operatively connected to at least one roller in the second pair of rollers;

a controller operatively connected to the first actuator and the second actuator, the controller being configured to identify only the amount of skew in the incoming substrate and to operate the first actuator and the second actuator independently of one another to only de-skew the incoming substrate.

3. The printer of claim 2, the electronic lateral registration system further comprising:

an image generator configured to generate an ink image; and the controller being operatively connected to the image generator, the controller being further configured to identify only a lateral position of the de-skewed substrate in the cross-process direction and to operate the image generator to position an ink image on the de-skewed substrate at a position in the print zone that corresponds to the identified lateral position of the de-skewed substrate.

4. The printer of claim 3, the image generator further comprising:

a printhead array having a plurality of printheads, each printhead having a plurality of inkjets, a width of the printhead array in the cross-process direction being greater than a width of the print zone in the cross-process direction; and the controller being further configured to send image data to inkjets in the printheads of the printhead array that correspond only to a width of the de-skewed substrate at the identified lateral position of the de-skewed substrate in the print zone to enable the inkjets receiving the image data to form an ink image on the de-skewed substrate at the identified lateral position in the print zone.

5. The printer of claim 4, the image generator further comprising:

a rotating member having a width in the cross-process direction that is greater than a width of the print zone in the cross-process direction; and the controller being further configured to send the image data to inkjets in the printheads of the printhead array that correspond only to a width of the de-skewed substrate at the identified lateral position of the de-skewed substrate in the print zone to enable the inkjets receiving the image data to form an ink image on a portion of the rotating member that corresponds to the width of the de-skewed substrate at the identified lateral position in the print zone.

6. The printer of claim 5, the controller being further configured to identify only the lateral position of the substrate in the print zone with reference to the positions of the outboard edge and the inboard edge after the identified amount of skew has been removed from the substrate.

7. The printer of claim 6 further comprising:

a plurality of photoelectric sensors linearly arranged in the process direction, each photoelectric sensor being configured to generate a signal indicating a presence or absence of a portion of the substrate at the photoelectric sensor; and the controller being operatively connected to the photoelectric sensors, the controller being further configured to operate the first and the second actuators with reference to the signals generated by the photoelectric sensors and the identified amount of skew in the substrate.

8. The printer of claim 4 wherein the controller operates the inkjets in the printheads of the printhead array to eject drops of ink directly onto the de-skewed substrate with the width of the de-skewed substrate at the identified lateral position of the de-skewed substrate in the print zone.

9. The printer of claim 3 further comprising:

a plurality of charged coupled devices that generate signals identifying a position of an outboard edge of the incoming substrate and a position of an inboard edge of the incoming substrate; and the controller being operatively connected to the charged coupled devices, the controller being further configured to identify only the amount of skew for the substrate with reference to the positions of the outboard edge and the inboard edge of the incoming substrate.

10. A method of operating a printer comprising:

identifying with a mechanical de-skewing device only an amount of skew in an incoming substrate;

removing with the mechanical de-skewing device only the identified amount of skew from the incoming substrate to de-skew the substrate before the incoming substrate enters a print zone;

identifying with an electronic lateral registration system only a lateral position of the de-skewed substrate in a cross-process direction in the print zone before the de-skewed substrate enters the print zone; and sending with the controller image data only to inkjets that correspond to a width of the de-skewed substrate at the identified lateral position of the de-skewed substrate in the print zone.

11. The method of claim 10, the removal of the amount of skew from the substrate further comprising:

operating with the controller a first actuator operatively connected to the controller and a second actuator operatively connected to the controller, the operation of the first actuator by the controller being independent of the operation of the second actuator by the controller to remove only the identified amount of skew from the incoming substrate.

12. The method of claim 11 further comprising:

identifying with the controller only a lateral position of the de-skewed substrate in the cross-process direction; and operating with the controller an image generator operatively connected to the controller to position an ink image on the de-skewed substrate at a position in the print zone that corresponds to the identified lateral position of the de-skewed substrate.

13. The method of claim 12 further comprising:

sending with the controller image data to inkjets in printheads of a printhead array operatively connected to the controller, the inkjets to which the controller sends the image data corresponding only to a width of the de-skewed substrate at the identified lateral position of the de-skewed substrate in the print zone to enable the inkjets receiving the image data to form an ink image on the de-skewed substrate at the identified lateral position in the print zone.

14. The method of claim 13, the sending of the image data further comprising:

sending with the controller the image data to the inkjets in the printheads of the printhead array that correspond only to a width of the de-skewed substrate on a rotating member, the width of the de-skewed substrate on the rotating member corresponding to the identified lateral position of the de-skewed substrate in the print zone to enable the inkjets receiving the image data to form an ink image on a portion of the rotating member that corresponds to the width of the de-skewed substrate at the identified lateral position in the print zone.

15. The method of claim 14, the identification of the lateral position of the de-skewed substrate in the print zone further comprising:

identifying with the controller the lateral position of the de-skewed substrate in the print zone with reference to the positions of the outboard edge and the inboard edge after the identified amount of skew has been removed from the incoming substrate.

16. The method of claim 15 further comprising:

operating with the controller the first and the second actuators with reference to the signals generated by photoelectric sensors operatively connected to the controller and linearly arranged in a process direction that indicate a presence or absence of a portion of the substrate at the photoelectric sensor and the identified amount of skew in the substrate.

17. The method of claim 13 further comprising:

operating the inkjets in the printheads of the printhead array with the image data sent to the inkjets by the controller to eject drops of ink directly onto the de-skewed substrate within the width of the de-skewed substrate at the identified lateral position of the de-skewed substrate in the print zone.

18. The method of claim 12 further comprising:

identifying with signals generated by a plurality of charged coupled devices a position of an outboard edge of the skewed substrate and a position of an inboard edge of the incoming substrate; and identifying with the controller the amount of skew for the incoming substrate with reference to the signals from the plurality of charged coupled devices identifying the positions of the outboard edge and the inboard edge of the incoming substrate.

* * * * *